US005293894A

United States Patent [19]

Fleischmann

[11] Patent Number: 5,293,894

[45] Date of Patent: Mar. 15, 1994

[54] AUTOMATIC PRIME AND FLUSH SIPHON CONDENSATE PUMP SYSTEM

[76] Inventor: Lewis W. Fleischmann, 8502 Allenswood Rd., Randallstown, Md. 21133

[21] Appl. No.: 16,462

[22] Filed: Feb. 11, 1993

[51] Int. Cl.[5] ..... F04F 10/00

[52] U.S. Cl. ..... 137/135; 137/140; 137/147; 137/151; 417/40

[58] Field of Search ..... 137/135, 140, 147, 151; 417/40

[56] References Cited

U.S. PATENT DOCUMENTS

| | | | |
|---|---|---|---|
| 2,363,313 | 11/1944 | Gavin | 137/131 X |
| 2,981,196 | 4/1961 | Zimmerman et al. | 417/40 |
| 3,753,236 | 9/1973 | Zimmerman | 417/40 X |
| 4,248,258 | 2/1981 | Devitt et al. | 137/147 X |
| 4,406,300 | 9/1983 | Wilson | 137/135 X |
| 5,044,391 | 9/1991 | Brumfield | 137/151 |

*Primary Examiner*—Gerald A. Michalsky
*Attorney, Agent, or Firm*—Morton J. Rosenberg; David I. Klein

[57] ABSTRACT

An automatic prime and flush siphon condensate pump system (100) is provided for displacing condensate water accumulated from an air conditioning evaporator to a drain, such as the drain of a basin (50). Initially, the pump assembly (2) displaces the condensate from the reservoir (1) responsive to the closure of a switch (34) when the condensate level exceeds a predetermined height within reservoir (1). The pump outlet (128) is coupled to the inlet of a pilot operated check valve assembly (3) which is opened responsive to the pressure in the valve chamber (28) exceeding the bias force of the compression spring (33) and a fluid pressure in a reference chamber (29). The pumped condensate exits the pilot operated check valve assembly (3) and is fluidly coupled to the ball-type check valve housing (126) for delivery of the condensate to the passage (18) for fluid coupling with the drain conduit (52). Subsequently, when the level of condensate within the reservoir (1) drops sufficiently such that switch (34) opens, condensate is then free to flow through the U-shaped siphon housing (122). The siphon flow is regulated by a flow regulating valve assembly (4), having a valve actuator (10) coupled to the float (5). The siphon flow from the flow regulating valve assembly (4) passes through the passage (130), the passage (13), past the ball check (14), through the check valve chamber (16), and finally through the passage (18) to the drain conduit (52).

19 Claims, 4 Drawing Sheets

AUTOMATIC PRIME AND FLUSH SIPHON CONDENSATE PUMP SYSTEM

BACKGROUND OF THE INVENTION

1. Field of the Invention

This invention directs itself to a fluid transfer system utilizing siphon principles. In particular, this invention directs itself to a condensate displacement system wherein a pump is utilized to initiate siphon flow. Still further, this invention directs itself to a condensate displacement system having a flow regulation valve disposed at the inlet to the siphon assembly, providing a siphon flow rate which is proportional to the height of the condensate within the condensate reservoir. More in particular, this invention pertains to a condensate displacement system having a position sensitive switch coupled to a float for actuating a pump when the condensate level exceeds a predetermined value. Further, the position sensitive switch includes a displaceable mass for closing an electrical circuit for actuating a pump and increasing the buoyancy of the float, thereby providing hysteresis for the operation of the switch, allowing the pump to run longer than would otherwise occur.

2. Prior Art

Pumping and siphoning systems, and their combination, are well known in the art. The best prior art known to the Applicant includes U.S. Pat. Nos. 2,363,313; 3,575,004; 4,573,490; 301,391; 4,255,937; 3,011,510; 4,041,971; 2,387,483; 5,044,391; 3,491,787; 4,488,408; 4,250,629; 2,142,556; and, 4,414,997.

In some prior art systems, such as that disclosed by U.S. Pat. No. 2,363,313, there is disclosed the combined pumping and siphoning of liquids from one location to another. In such systems, both the siphon and pump have a common inlet, and thus the pump cannot be primed unless the reservoir level is above the siphon inlet. It is further noted that such systems provide for automatic flow regulation responsive to the height of fluid at the second location, but provide no means for limiting the flow responsive to the level of fluid in the supply reservoir. Since these systems have no means for regulating the flow responsive to the fluid level in the supply reservoir, air is able to enter the system when the fluid level falls below the inlet to the siphon, and thereby break the siphon, requiring the pump to be enabled when the fluid level subsequently rises. As a result of this deficiency, the disclosed system provides for air relief valves to remove entrapped air from the siphon. Such apparatus is not required by the instant invention since the flow control valve of the instant invention seals the siphon prior to the reservoir level dropping below the siphon inlet.

In other systems, such as that disclosed in U.S. Pat. No. 3,575,004, a siphon tube control device is provided to regulate the liquid flow therethrough. In such systems a valve is provided at the outlet of the siphon tube which is actuated in response to a predetermined liquid level at the tube inlet for alternately stopping and starting the liquid flow through the tube. However, such systems are not self-priming, requiring a manual initial priming thereof.

SUMMARY OF THE INVENTION

A system for transferring fluid from a first location to a second location is provided. The system includes a fluid reservoir which defines the first location, the fluid reservoir being positionally located a predetermined vertical distance above the second location. The system further includes a fluid inlet in fluid communication with the reservoir for supplying the fluid thereto. Additionally, the system includes a siphon assembly disposed within the reservoir for displacing the fluid from the reservoir responsive to a level of the fluid therein being between a first predetermined height dimension and a second predetermined height dimension. The first predetermined height dimension is greater than the second predetermined height dimension. The siphon assembly includes a substantially U-shaped housing having a siphon inlet on one end and an outlet coupling formed on another end thereof, thereby defining a first fluid flow passage. The outlet coupling is in fluid communication with the second location. The siphon assembly further includes a check valve assembly disposed in the first fluid flow passage intermediate the siphon inlet and the outlet coupling, for interrupting flow of the fluid therethrough responsive to fluid pressure at the outlet coupling exceeding a first predetermined value. The system further includes a pump assembly disposed within the reservoir and having a pump output in fluid communication with the outlet coupling to define a second fluid flow passage, for displacing the fluid from the reservoir responsive to a level of the fluid within the reservoir exceeding the first predetermined height dimension. The fluid displacement by the pump assembly is sufficient to raise the pressure at the outlet coupling above the first predetermined value.

DESCRIPTION OF THE PREFERRED EMBODIMENTS

Figure 6:
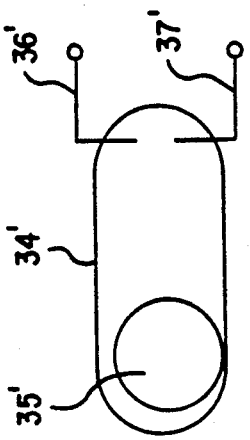

Referring now to FIGS. 1-6, there is shown automatic prime and flush siphon condensate pump system 100 for displacing condensate water accumulated in a reservoir 1 to a drain. As will be seen in following paragraphs, automatic prime and flush siphon condensate pump system 100 is specifically directed to the concept of minimizing the operation of the pump assembly 2 by utilizing siphon principles. Pump assembly 2 is utilized initially to fill the drain line with fluid, and thereafter only to clear the drain line of any accumulation of debris, or at any time when the siphon flow rate is insufficient to keep up with the condensate flowing into reservoir 1. Although not restricted to transferring condensate water accumulated from an air conditioning evaporator unit, automatic prime and flush siphon condensate pump system 100 is particularly adapted for utilization with air conditioning units in private homes and commercial establishments where the noise generated by intermittent pump operation is considered objectionable and where accumulation of debris in the drain pipe 52 could cause an overflow spill. Thus, system 100 is designed to operate silently, substantially without requiring electrical power, primarily utilizing siphon principles for displacing the condensate water, transferred to the reservoir 1 from the evaporator condensate drain pipe 56, to a remote drain, such as that found in the basin 50. Additionally, system 100 provides a condensate displacement system having increased reliability and a longer useful service life than that of conventional units, as the pump is not continuously being cycled "on" and "off".

Figure 1:
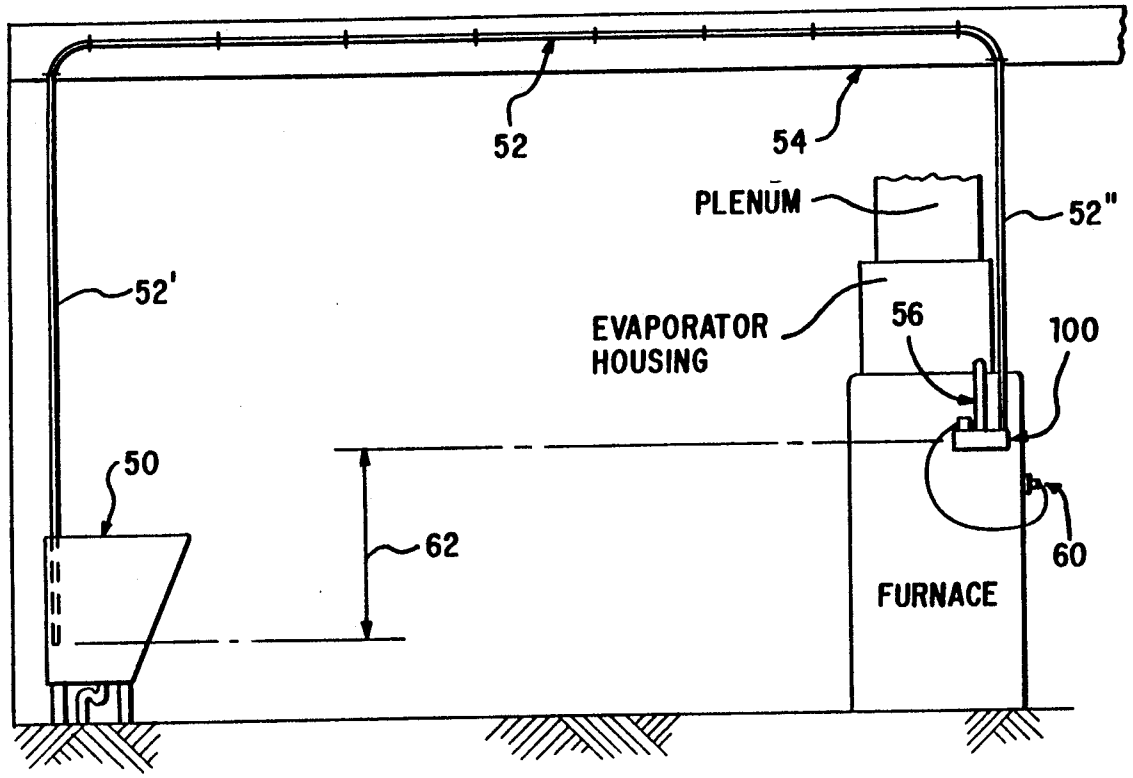
FIG. 1 is an elevation view depicting the installation of the present invention.

Referring to FIG. 1, such shows a typical installation of the automatic prime and flush siphon condensate pump system 100. Typically, in both residential and commercial applications, the evaporator unit of an air conditioning system is mounted above the heating furnace, and is provided with a condensate drain, from which a condensate drain pipe 56 extends. In many such installations, the drain pipe 56 is extended directly to a drainage system, thereby transferring the condensate water by gravity feed. However, in a large number of installations the drainage system is sufficiently remote from the evaporator so as to require a condensate pump for transferring the condensate water from the drain pipe 56 to the drainage system, such as that provided by the basin 50.

Figure 2:
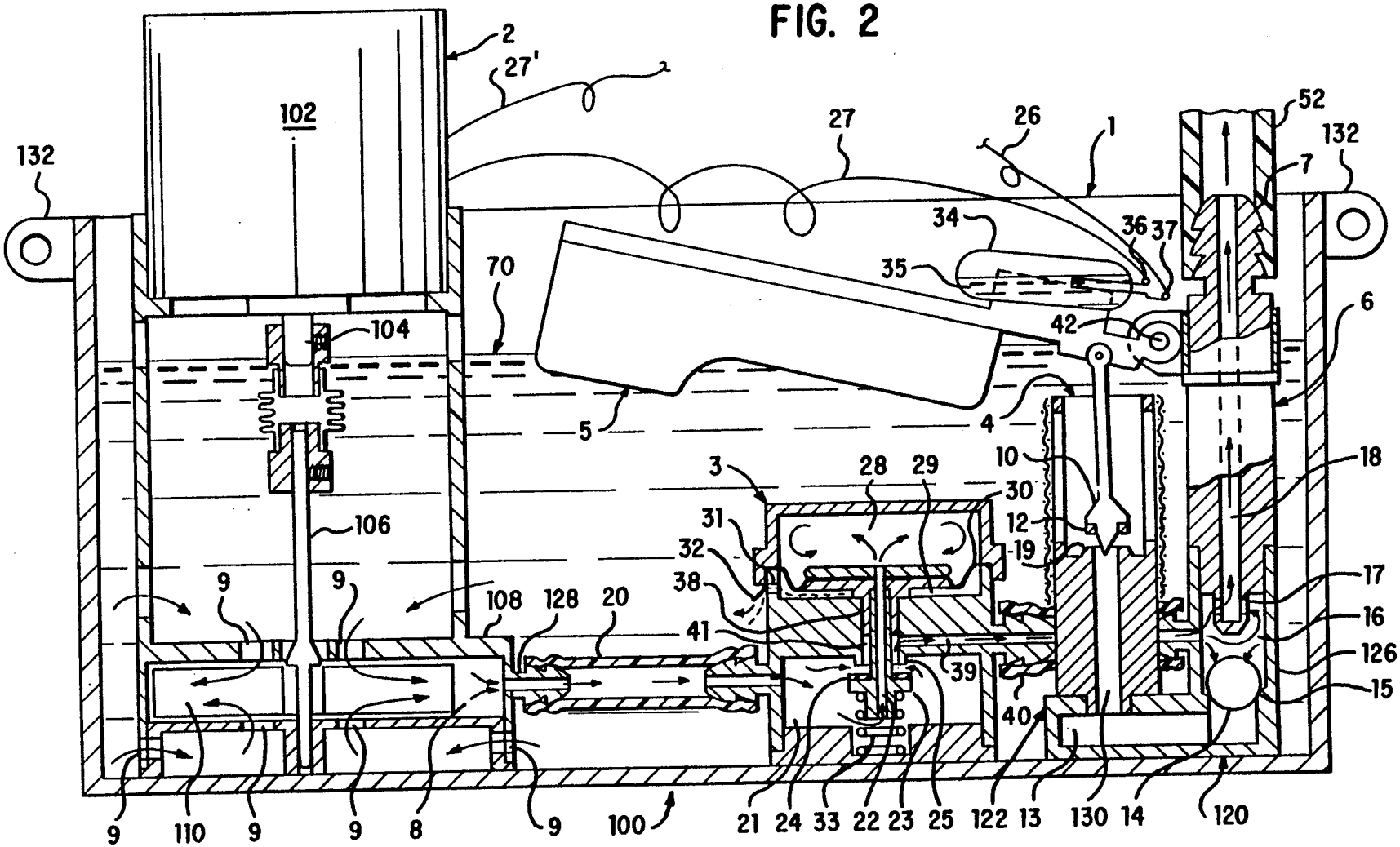
FIG. 2 is a frontal sectional view, partially cut-away, depicting operation of the pump assembly.

In such installations, system 100 is mounted to a side of the furnace, utilizing the mounting flanges 132, shown in FIG. 2. System 100 is mounted to the furnace, as shown in FIG. 1, a predetermined minimum height 62 above the end of drain pipe 52 disposed within the basin 50. In this manner, the drain pipe 52 extends from system 100 vertically upward through a length of drain pipe 52" to a support member 54, to which the pipe is secured. Drain pipe 52 extends horizontally to the remotely located basin 50 and then extends downward vertically through a length 52', the length of drain pipe 52' being longer than the length 52" by substantially the distance 62. In one working embodiment, a minimum differential between the lengths of drain pipe portion 52' and 52" of 18 inches has been found to provide satisfactory siphon action. An electrical outlet 60 mounted to the furnace provides the power source for operating the pump assembly 2 of system 100.

Referring now to FIG. 2, there is shown system 100 in an initial priming or subsequent flush cycle operation. As previously described, condensate water is provided to the reservoir 1 through the drain pipe 56. As the condensate level within reservoir 1 rises, such displaces the float 5. The float 5 is pivotally coupled to the U-shaped siphon housing 122 by means of the pivotal coupling joint 42. When the condensate level 70 exceeds a predetermined height, the distal end of float 5 is sufficiently vertically displaced to orient a position sensitive switch 34 such that it provides a contact closure, the contact closure providing an electrical input signal to the motor 102 of the pump assembly 2. A power supplying conductive lead 26 supplies power from the outlet 60 to the contact terminal of the electrode 37 of switch 34. A contact terminal of a second electrode 36 of switch 34 is coupled to a motor conductive lead 27 for supplying the electrical input to motor 102. Motor 102 includes a second conductive lead 27' which is coupled to the return conductor of the outlet 60, to thereby complete the electrical path through motor 102.

Position sensitive switch 34 may be a mercury switch, wherein a pool of mercury 35 is displaceable within the glass capsule of switch 34, to make contact between the conductive electrodes 36 and 37 disposed at one end of the switch. While many different types of switches may be utilized in place of mercury switch 34, the operation of system 100 is enhanced through the use of a switch having a displaceable mass, as will be described in following paragraphs. Thus, one possible alternative to mercury switch 34 is the position sensitive switch 34', shown in FIG. 6. Switch 34' utilizes a metallic ball 35' to make or break a conductive path established between ball 35' and the pair of electrodes 36' and 37', responsive to the orientation of the switch 34'.

It is desirable that the pump unit 2 be operated for a sufficient length of time, subsequent to contact closure of switch 34, to completely fill the drain conduit 52, or clear such of debris during a flush cycle. The displaceable mass 35 within switch 34 provides this function in addition to completing the electrical circuit between the electrodes 36 and 37. When the float 5 is raised by the condensate water within reservoir 1, the mass 35 is displaced toward the pivot point of float 5, thereby changing the float's center of gravity, and having the effect of making the float 5 more buoyant. Since the buoyant force of the condensate water required to maintain the float's position is reduced, the water level height at which the switch 34 "opens" will be below the water level 70 at which the switch "closed". Hence, the movable mass 35 of switch 34, by virtue of its effect on the buoyancy of float 35 provides hysteresis to the switch's operation, causing the motor to run longer than would be the case if the "on" and "off" points were substantially the same.

Motor 102 has an output shaft 104 which is coupled to the shaft 106 of pump 108. Motor 102 provides the driving force for rotation of the impeller 110 of pump 108. While an impeller type pump is shown, it is understood that many other types of pumps could be substituted therefor, without departing from the spirit or scope of the inventive concept. Pump assembly 2 is provided with a plurality of through openings 9 to allow the condensate water to enter the pump chamber 8 for self-priming and subsequent displacement therefrom to the pump outlet 128, by the rotary action of impeller 110. The condensate flows from the pump outlet 128 through a conduit 20 to the pilot operated check valve assembly 3.

Figure 4:
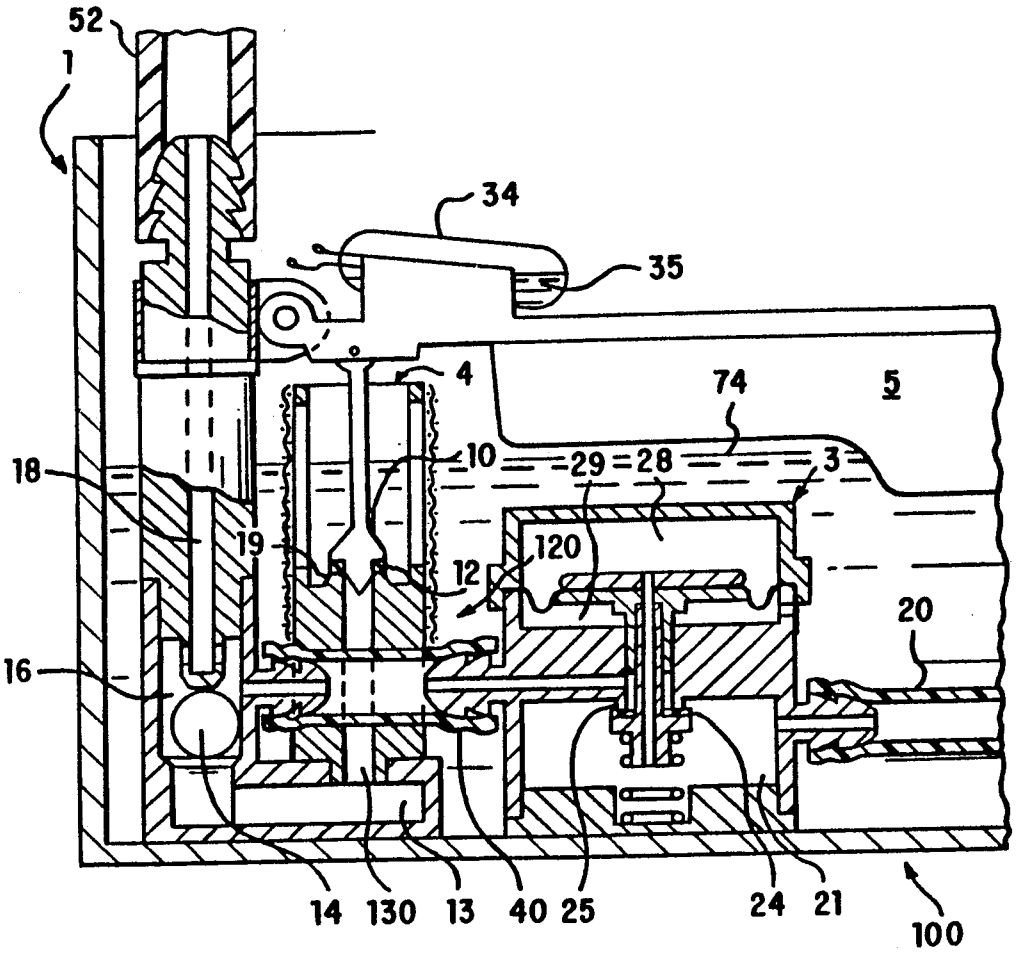
FIG. 4 is a partial sectional rear view, partially cut-away, depicting the present invention when neither the pump nor siphon assemblies are operational.

The condensate being supplied from conduit 20 enters the valve inlet chamber 21 of check valve assembly 3, where initially the valve seal 24 is biased against the valve seat 25 by spring 33 (see FIG. 4). The condensate flows from inlet chamber 21 to the upper pressure sensing chamber 28 through the transfer passage 22, under the pressure supplied by the pump 108. Transfer passage 22 is disposed within the valve stem core 23, and carries the pressurized condensate to chamber 28, wherein it acts on the large area presented by diaphragm 30. The pressure of the condensate within chamber 28 acts against the bias force of spring 33 and fluid disposed within the lower, reference pressure chamber, 29. The fluid within chamber 29 is displaced by the diaphragm 30 and vented through the bleed port 31, as well as through the valve outlet port 39, by virtue of the loose fit between the valve stem upper portion 38 and the vertical passage 41 of check valve assembly 3.

Responsive to displacement of diaphragm 30, the valve stem 23, 38 is displaced to thereby separate the valve seal 24 from the seat 25. With the valve seal 24 displaced from the seat 25 the pressurized condensate flows into the vertical passage 41 and through the valve outlet port 39 to the conduit 40. Conduit 40 is coupled to the ball-type check valve housing 126, upstream of the ball check 14. The condensate flows into the valve chamber 16, through the outlet ports 17, and into the outlet passage 18 for fluid coupling with the drain conduit 52. The drain conduit 52 is coupled to the outlet coupling nipple 7, formed at the distal end of the check valve housing 126.

The ball-type check valve assembly 6 is disposed within the check valve housing 126 with a check ball 14 disposed within the chamber 16 and displaceable with respect to the ball valve seat 15. The check ball 14 has a specific gravity slightly less than that of water, and may be formed from polyethylene or a like material. Although the check ball 14 tends to float within the chamber 16, under the pressure and flow rate of the pumped condensate entering chamber 16 from conduit 40, the check ball 14 is forced downward against seat 15, thereby preventing the condensate from flowing back into the reservoir through the interconnected passages 13 and 130, and the open flow rate control valve 4, while not impeding the siphon flow which follows the pumping operation.

Figure 3:
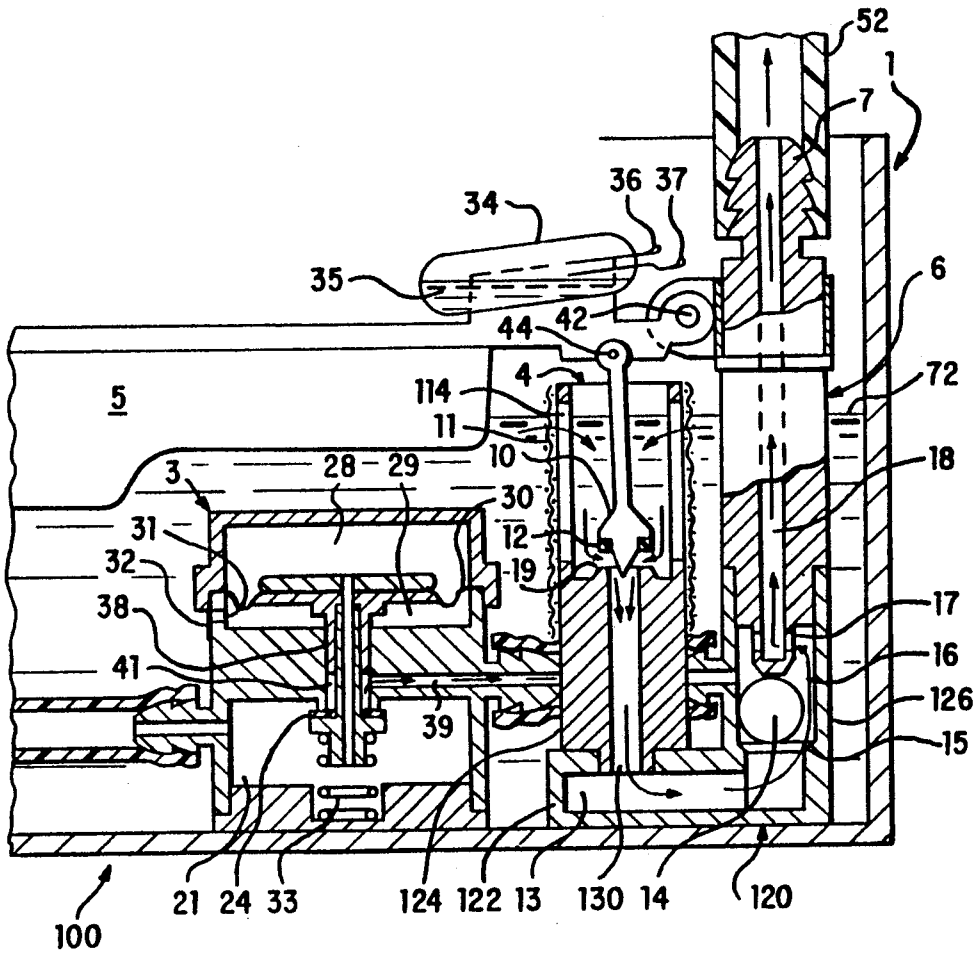
FIG. 3 is a partial front sectional view, partially cut-away, depicting operation of the siphon assembly.

When the level of the condensate level 72 within reservoir 1 drops below a predetermined height, as shown in FIG. 3, contact between the electrodes 36 and 37 is broken, shutting down the pump assembly 2. Diaphragm 30 senses the reduced pressure which is transferred from the inlet chamber 21 to the pressure sensing chamber 28, the reduced pressure being insufficient to overcome the force of the compression spring 33, the spring 33 then displacing the valve stem 23, 38 and the diaphragm 30. Valve seal 24 is thus forced against the valve seat 25, thereby closing the fluid flow path between chamber 21 and the outlet port 39. The upward displacement of diaphragm 30 creates a negative pressure within the lower chamber 29, the negative pressure being transmitted through the bleed port 31 to the flap-type check 32, which may be formed by an extension of a portion of the diaphragm 30 which overlays the bleed port 31. The negative pressure acting on the flap 32 provides a seal for the bleed port 31. Due to the non-sealing fit between the upper portion 38 of the valve stem and the vertical passage 41, fluid is drawn from the outlet port 39 past the valve stem upper portion 38 into chamber 29 to equalize the pressure therein. Thus, responsive to the absence of fluid pressure from the pump 108, the valve seal 24 interrupts the flow path between chamber 21 and valve outlet port 39, thereby preventing any reverse flow of condensate from the vertical portion of drain conduit 52" back into reservoir 1, should drain pipe 52 not yet be fully charged with condensate.

Figure 5:
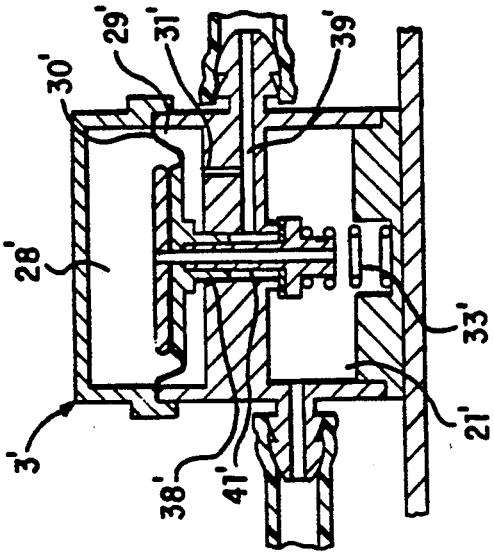
FIG. 5 is an elevation sectional view of an alternate embodiment of the pilot operated check valve of the present invention; and, FIG. 6 is an alternate embodiment of a position sensitive switch for the present invention.

Referring now to FIG. 5, there is shown an alternate embodiment of the pilot operated check valve. Pilot operated check valve 3' differs from pilot operated check valve 3 only with respect to the location of the bleed port. Pilot operated check valve 3' includes a bleed port 31' extending between the lower chamber 29' and the valve outlet port 39'. Thus, when there is an increase in pressure within the upper chamber 28', causing displacement of the diaphragm 30', the fluid displaced from the lower chamber 29 passes through the bleed port 31' to the valve outlet port 39'. There is sufficient flow resistance through the valve such that the differential pressure between the upper chamber 28' and lower chamber 29' to displace the valve member to an "open" condition will exist against the bias force of spring 33'.

Referring now to FIG. 3, there is shown, system 100 at the point in its operation wherein the level of the condensate within reservoir 1 is at an intermediate level 72, a level where the pump assembly 2 is not running and the condensate is transferred to the drain of the basin 50 by a siphoning action. The siphon assembly 120 defines the primary fluid flow passage from reservoir 1 to the drain of basin 50, the flow being through the U-shaped siphon housing 122, from the inlet of the flow control valve 4, through the passages 130 and 13, through the valve chamber 16 and the outlet passage 18 to the drain conduit 52.

The inlet to the flow control valve 4 is defined by a plurality of openings 114 formed in the valve housing 124, over which there is provided a fine mesh filter screen 11. At the uppermost end of the passage 130 formed in housing 124, there is provided a valve seat 19 which interfaces with a valve seal 12 carried by an actuator 10. The actuator 10 is coupled to the float 5 by means of a pivotal coupling 44, and is vertically displaceable responsive to displacement of float 5. Thus, the flow through the siphon assembly 120 is regulated responsive to the level of condensate within reservoir 1. The spacing between the valve seal 12 and seat 19 is proportional to the condensate level, the higher the level, the greater the vertical displacement of float 5 with respect to its pivot 42, and likewise the greater the vertical displacement of the flow regulating valve actuator 10, permitting a greater flow to pass between the valve seal 12 and seat 19. Conversely, when the condensate level 74 falls below a predetermined minimum level, as shown in FIG. 4, the seal 12 is in contiguous contact with the valve seat 19 stopping the flow through the siphon assembly 120 until sufficient condensate from the air conditioning evaporator raises the float above the minimum condensate level 74, and thereby allowing the siphon action to resume. The proportional flow regulation provided by the flow control valve 4 maintains the fluid column from system 100 to the drain of basin 50 intact, providing the ability to resume and halt the flow of condensate from reservoir 1 cyclically, without allowing air into the system. The operation of the siphon can thereby substantially coincide with the cycling of the air conditioning unit producing the condensate.

As shown in FIG. 4, when the condensate level 74 falls to the predetermined level, the flow regulation valve 4 closes, thus interrupting the condensate flow through the primary flow passage. The secondary flow passage provided by conduit 20, pilot operated check valve 3 and conduit 40 is interrupted by the action of the pilot operated check valve 3, as the sealing element 24 is in contiguous contact with its respective seat 25. Thus, the negative pressure exerted by the condensate within the drain conduit 52 cannot empty reservoir 1, nor can any air enter the siphon assembly 120, which would otherwise break the siphon, thereby maintaining the column of negative pressure water within drain conduit 52.

During operation of the air conditioning system dust and dirt may get past the air conditioning system's filter and deposit on the evaporator coils of the unit. Such dust and dirt particles are washed from the evaporator coils by the condensate produced thereon, and pass into system 100. This debris may eventually accumulate in the long horizontal run of drain conduit 52. Such buildup of dust and dirt particles will increase the resistance to water flow through conduit 52, reducing the flow rate therethrough. During periods where condensate input from the air conditioning system is supplied at a higher flow rate than the outgoing flow rate through drain conduit 52, the condensate level within reservoir 1 will increase. When the level of condensate reaches the predetermined height of condensate level 70, which is above the open top of the flow regulation valve 4 and filter 114, as shown in FIG. 2, the mercury within the switch 34 will close the contacts formed by electrodes 36 and 37 to again initiate the pump system 2. The higher fluid pressure produced by the pump assembly 2, flowing through the secondary flow passage defined by conduit 20, pilot operated check valve 3 and conduit 40 is transmitted through the outlet passage 18 to the drain conduit 52, and will flush the build-up of dirt and dust particles therefrom.

Therefore, it can be seen that the unique arrangement of valves permit the combination of a pump unit and siphon to operate sequentially, whereby operation is automatically switched therebetween. The pump 108 is disposed within the reservoir 1, and provided with a plurality of through openings 9 to provide for self-priming thereof. The pump unit 2 operates initially to automatically prime the siphon system through its interconnection with the ball-type check valve housing 126, providing condensate to the valve chamber 16 for fluid coupling with the drain conduit 52 through the outlet passage 18. The pressurized flow generated by pump 108 displaces the ball check 14 into contiguous contact with the seat 15, thereby preventing flow from the pump 108 through the passages 13 and 130 into reservoir 1, allowing the full pressure and flow rate to pass into the drain conduit 52.

Subsequent to pump operation, the fluid level within the reservoir having fallen to an intermediate level 72, the pilot operated check valve 3 closes, allowing continued flow from reservoir 1 through the drain conduit 52 by a siphon action, through the U-shaped siphon assembly 120. The U-shaped siphon assembly 120 includes a housing 122 defined by the combination of the flow regulating valve housing 124 and the ball-type check valve housing 126. The inlet to the siphon flow passage is provided with a flow control valve 4 having a valve actuator 10 pivotedly coupled to the float 5. Flow control valve 4 thereby provides a flow restriction proportional to the height of the condensate within reservoir 1. When the condensate reaches a level 74, a predetermined minimum height, as shown in FIG. 4, flow control valve 4 closes, preventing further flow from reservoir 1 into drain conduit 52, as well as preventing reservoir 1 from being completely emptied and thereby breaking the siphon. Thus, the combination of flow control valve 4 and pilot operated check valve 3 provide the means for maintaining the integrity of the siphon flow path during time periods when condensate is not being generated, such as when the air conditioning unit is cycled off.

An automatic flush operation is triggered by an increase in the level of condensate in reservoir 1, raising the float 5 sufficiently to cause the position sensitive switch 24 to enable the pump assembly 2. The higher pressure produced by pump 108 clears the drain conduit 52 of debris, and results in a higher flow rate than that of the siphon alone. Thus, the automatic operation of pump assembly 2 will prevent overflow of condensate from reservoir 1 during the periods of unusually high condensate production by the air conditioning system. Position sensitive switch 34 includes a movable mass, whose displacement to "close" the switch changes the buoyancy of float 5, providing hysteresis for the switch operation. This change in buoyancy of float 5 has the effect of causing the pump to run longer than would otherwise occur if the operating point of the switch was substantially static.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is being claimed is:

1. A system for displacing condensate from a reservoir to a fluid drain, comprising:

a. a housing defining a condensate reservoir, said housing being positionally located a predetermined distance above said fluid drain;

b. a condensate inlet in fluid communication with said condensate reservoir for supplying condensate thereto;

c. an outlet coupling in fluid communication with said fluid drain;

d. pump means disposed within said condensate reservoir and having a first output fluidly coupled to said outlet coupling for displacing said condensate responsive to a level of said condensate within said reservoir exceeding a first predetermined height dimension;

e. siphon means disposed within said reservoir and having a second output fluidly coupled to said outlet coupling for displacing said condensate responsive to said condensate level being between said first predetermined height dimension and a second predetermined height dimension, said first predetermined height dimension being greater than said second predetermined height dimension, said siphon means including first valve means having an inlet in fluid communication with said reservoir and an outlet fluidly coupled to said outlet coupling for (1) preventing condensate from flowing back from said outlet coupling into said reservoir, and (2) regulating flow of condensate from said reservoir proportional to said condensate level in said reservoir.

2. The system for displacing condensate as recited in claim 1 where said siphon means further includes second valve means fluidly coupled to said second output for closing said second output responsive to displacement of said condensate from said first output.

3. The system for displacing condensate as recited in claim 1 where said first valve means includes: (1) a first check valve having a first valve inlet fluidly coupled to said first output of said pump means and a first valve outlet in fluid communication with said outlet coupling, and (2) a flow control valve having a second valve inlet in fluid communication with said reservoir and a second valve outlet fluidly coupled to an inlet to said siphon means.

4. The system for displacing condensate as recited in claim 3 where said first check valve is a pilot operated valve.

5. The system for displacing condensate as recited in claim 4 where said pilot operated valve includes a first valve seal displaceable from a first valve seat responsive to displacement of a diaphragm, said diaphragm being displaceable responsive to fluid pressure at said first valve inlet being greater than a reference pressure.

6. The system for displacing condensate as recited in claim 5 where said pilot operated valve further includes a spring member coupled to said first valve seal for providing a bias force to displace said first valve seal toward said first valve seat.

7. The system for displacing condensate as recited in claim 6 where said first valve means further includes a float member disposed within said reservoir for substantially vertical displacement responsive to changes in a height dimension of said condensate within said reservoir.

8. The system for displacing condensate as recited in claim 7 where said flow control valve includes a second valve seal coupled to said float member for displacing said second valve seal relative to a second valve seat responsive to said changes in a height dimension of said condensate within said reservoir.

9. The system for displacing condensate as recited in claim 8 where said siphon means further includes a second check valve having a third valve inlet fluidly coupled to said second valve outlet and a third valve outlet in fluid communication with said first valve outlet for substantially preventing condensate from flowing from said pump means into said siphon means.

10. The system for displacing condensate as recited in claim 7 where said pump means includes: (1) fluid displacement means having a pump inlet in fluid communication with said reservoir for displacing said condensate therefrom to said first output responsive to a mechanical driving force; (2) an electric motor having an output shaft coupled to said fluid displacement means for providing said mechanical driving force responsive to an electrical input signal, and (3) switch means coupled to said float member and electrically coupled to said electric motor for providing said electrical input signal responsive to said condensate level exceeding said first predetermined height dimension.

11. The system for displacing condensate as recited in claim 10 where said switch means includes a mercury switch, said mercury switch being positionally located on said float member for increasing buoyancy of said float member when said switch is in an on condition for providing a hysteresis effect to operation of said mercury switch.

12. A system for transferring fluid from a first location to a second location, comprising:

a. a fluid reservoir defining said first location, said fluid reservoir being positionally located a predetermined distance above said second location;

b. a fluid inlet in fluid communication with said reservoir for supplying said fluid thereto;

c. siphon means disposed within said reservoir for displacing said fluid from said reservoir responsive to a level of said fluid within said reservoir being between a first predetermined height dimension and a second predetermined height dimension, said first predetermined height dimension being greater than said second predetermined height dimension, said siphon means including a substantially U-shaped housing having a siphon inlet on one end and an outlet coupling formed on another end thereof defining a first fluid flow passage, said outlet coupling being in fluid communication with said second location, said siphon means including check valve means disposed in said first fluid flow passage intermediate said siphon inlet and said outlet coupling for interrupting flow of said fluid therethrough responsive to fluid pressure at said outlet coupling exceeding a first predetermined value, said siphon means further including means for regulating fluid flow through said first fluid flow passage, said flow regulating means being fluidly coupled to said siphon inlet, said flow regulating means including (1) a float member disposed within said reservoir for substantially vertical displacement responsive to changes in a height dimension of said fluid within said reservoir, and (2) a valve actuating member coupled to said float member for displacing a valve seal with respect to a valve seat responsive to displacement of said float member, said valve seat being formed at said siphon inlet; and, d. pump means disposed within said reservoir and having a pump output in fluid communication with said outlet coupling to define a second fluid flow passage for displacing said fluid from said reservoir responsive to a level of said fluid within said reservoir exceeding said first predetermined height dimension, said fluid displacement by said pump means being sufficient to raise said pressure at said outlet coupling above said first predetermined value, said pump means including pressure responsive check valve means disposed in said second fluid flow passage for preventing fluid from flowing back from said outlet coupling to said pump responsive to fluid pressure at said pump output falling below a second predetermined value.

13. The system for transferring fluid as recited in claim 12 where said check valve means is a ball-type check valve.

14. The system for transferring fluid as recited in claim 12 where said pump means includes: (1) fluid displacement means having a pump inlet in fluid communication with said reservoir for displacing said fluid therefrom to said first output responsive to a mechanical driving force; (2) an electric motor having an output shaft coupled to said fluid displacement means for providing said mechanical driving force responsive to an electrical input signal, and (3) switch means coupled to said float member and electrically coupled to said electric motor for providing said electrical input signal responsive to said condensate level exceeding said first predetermined height dimension.

15. The system for transferring fluid as recited in claim 14 where said switch means includes a switch housing and means for closing an electrical circuit responsive to said switch housing being oriented in a predetermined position, said electrical circuit closing means being defined by a displaceable mass, said switch housing being positionally located on said float member for increasing buoyancy of said float member when said displaceable mass is displaced to close said electrical circuit for providing a hysteresis effect to operation of said switch means.

16. The system for transferring fluid as recited in claim 14 where said pressure responsive check valve means is a pilot operated valve.

17. The system for transferring fluid as recited in claim 16 where said pilot operated valve includes a sealing member displaceable from a valve flow passage responsive to displacement of a diaphragm, said diaphragm being displaceable responsive to fluid pressure at an inlet of said pilot operated valve being greater than a reference pressure.

18. The system for transferring fluid as recited in claim 17 where said reference pressure is a pressure of said fluid in said reservoir external said pilot operated valve and a spring bias force.

19. The system for transferring fluid as recited in claim 17 where said reference pressure is a pressure of fluid at an outlet of said pilot operated valve and a spring bias force.

* * * * *